US006557913B1

(12) United States Patent
Kunst

(10) Patent No.: US 6,557,913 B1
(45) Date of Patent: May 6, 2003

(54) MOTOR VEHICLE DOOR LOCK

(75) Inventor: Frank Kunst, Olfen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/715,922

(22) Filed: Nov. 20, 2000

(30) Foreign Application Priority Data

Nov. 20, 1999 (DE) ..... 199 56 012

(51) Int. Cl.[7] ..... E05B 15/02

(52) U.S. Cl. ..... 292/340; 292/DIG. 38; 292/DIG. 55

(58) Field of Search ..... 292/340, 341.14, 292/DIG. 53, DIG. 54, DIG. 55, DIG. 38

(56) References Cited

U.S. PATENT DOCUMENTS

| | | | | | |
|---|---|---|---|---|---|
| 4,308,934 | A | | 1/1982 | Jackson et al. | 182/184 |
| 4,580,823 | A | * | 4/1986 | Yamada et al. | 292/340 |
| 5,181,754 | A | * | 1/1993 | Shibata | 292/216 |
| 5,222,775 | A | | 6/1993 | Kato | 292/201 |
| 5,927,774 | A | * | 7/1999 | Granger | 292/340 |
| 6,209,932 | B1 | * | 4/2001 | Jung et al. | 292/216 |

FOREIGN PATENT DOCUMENTS

| | | | | |
|---|---|---|---|---|
| DE | 37 13 558 | | 8/1988 | |
| DE | 39 07 674 | | 9/1989 | |
| FR | 1.484.779 | * | 5/1967 | 292/341.14 |
| FR | 2 773 580 | | 7/1999 | |

OTHER PUBLICATIONS

The American Heritage Dictionary of the English Language, Third Edition copyright 1992; definition of flange.*

Niemann, G., "Maschinenelemente", pp. 44–93, 1975, Band I, Konstruktion und Berechnung von Verbindungen, Lagern, Wellen.

Tabellen, Formeln, Normen, "Tabellenbuch Metall", pp. 137–144, 1978, Europa Lehrmittel.

Jutz et al., "Stoff Zahl Form—Tabellen für das Metallgewerbe" (Material Number Form—Tables for the Metal Trade), 2 Pages, 1958, Georg Westermann Verlag, 9th Issue.

Sass et al., "Dubbels Taschenbuch für den Maschinenbau" (Dubbel's Pocket Book for Mechanical Engineering), pp. 340–349, 1963, Springer Verlag, 12th Issue.

Letter from Audi (dated Nov. 12, 2001).

Response letter from Robert Bosch GmbH (dated Nov. 23, 2001).

* cited by examiner

*Primary Examiner*—Anthony Knight
*Assistant Examiner*—John B. Walsh
(74) *Attorney, Agent, or Firm*—Nixon Peabody LLP; David S. Safran

(57) ABSTRACT

A motor vehicle door lock with a bent carrier plate having a flat side connected to a side section via a bend, for stiffening purposes, has a peripheral bent edge section which extends around an inlet slot for a clamp in the flat side of the carrier plate, across the bend and in the side section.

8 Claims, 3 Drawing Sheets

MOTOR VEHICLE DOOR LOCK

BACKGROUND OF THE INVENTION

1. Field of the Invention

This invention relates to a motor vehicle door lock with a metallic carrier plate and an associated locking mechanism, the carrier plate having a flat side, a side section bent from it, and an inlet slot extending from the flat side into the side section for a clamp which is of the motor vehicle door lock and which can be secured by the locking mechanism in the inlet slot in the area of the flat side, the inlet slot having a bent edge section which extends in the area of the flat side along at least one part of the edge of the inlet slot.

2. Description of Related Art

A motor vehicle door lock with the initially named features is already known from practice. One such motor vehicle door lock which is shown by way of example in FIG. 1 has a metallic carrier plate with one flat side and a side section bent from it. In the carrier plate, an inlet slot extends from the flat side to the side section for a clamp of the motor vehicle door lock. The locking mechanism of the motor vehicle door lock can secure the clamp in the inlet slot in the area of the flat side. To achieve comparatively high stability and load-bearing capacity, especially in an accident, the inlet slot is provided with a bent edge section in the area of the flat side which extends along a part of the edge of the inlet slot and which leads to stiffening of the carrier plate.

It has been shown that a motor vehicle door lock of the known type requires a carrier plate of comparatively thick plate material when the desired stiffness and load-bearing capacity, especially high tensile strength, are to be achieved.

SUMMARY OF THE INVENTION

The primary object of the invention is to devise a motor vehicle door lock which enables use of a carrier plate of thinner plate material with comparable tensile strength of the motor vehicle door lock and/or has higher stiffness or tensile strength.

The aforementioned object is achieved in accordance with the present invention by a motor vehicle door lock in which the bent edge section extends from the flat side via a transition into the side section along the edge of the inlet slot.

The underlying idea of this invention is to "pull around" or lengthen the bent edge section around the transition from the flat side of the carrier plate to the side section of the carrier plate. It has been found that, in this way, surprisingly, high stiffness of the carrier plate and the motor vehicle door lock can be achieved. Since the locking mechanism of the motor vehicle door lock, which has especially a lock latch for securing the clamp of the motor vehicle door lock in the inlet slot, is directly or indirectly supported on the carrier plate, accordingly higher tensile strength and higher holding force of the motor vehicle door lock in the closed state can be achieved when using a carrier plate of plate material with the previously conventional thickness. In the individual case, the approach of the invention, even when using a carrier plate of thinner plate material as compared to that of the prior art, can lead to higher stiffness and tensile strength of the motor vehicle door lock.

Optimum stiffness and tensile strength are preferably achieved by the bent edge section extending around the entire inlet slot or along the entire edge of the inlet slot. Alternatively, the bent edge section can also be interrupted in areas.

Simple production is preferably achieved in that the initially flat carrier plate for an already bent edge section with a relatively large bending radius is bent or bevelled in the area of the transition from the flat side to the side section of the carrier plate. Surprisingly, it has been shown that, in spite of or due to this large bending radius, high stiffness and tensile strength of the motor vehicle door lock can be achieved.

Preferably the edge section is bent to the outside, i.e., pointing away from the lock mechanism.

Simple production is achieved in that the edge section has at least essentially the same width and thickness along the edge of the inlet slot. In particular, the aforementioned bending radius is matched thereto.

However, the width and/or the thickness of the edge section can also be varied along the edge of the inlet slot in order to enable, for example, an optimum compromise between stiffening and minimization of the required bending radius in the transition from the flat side to the side section and still to achieve very high or optimum stiffening by the edge section in other areas.

Other details, features and advantages of this invention are explained below using the drawings.

DETAILED DESCRIPTION OF THE INVENTION

Figure 1:
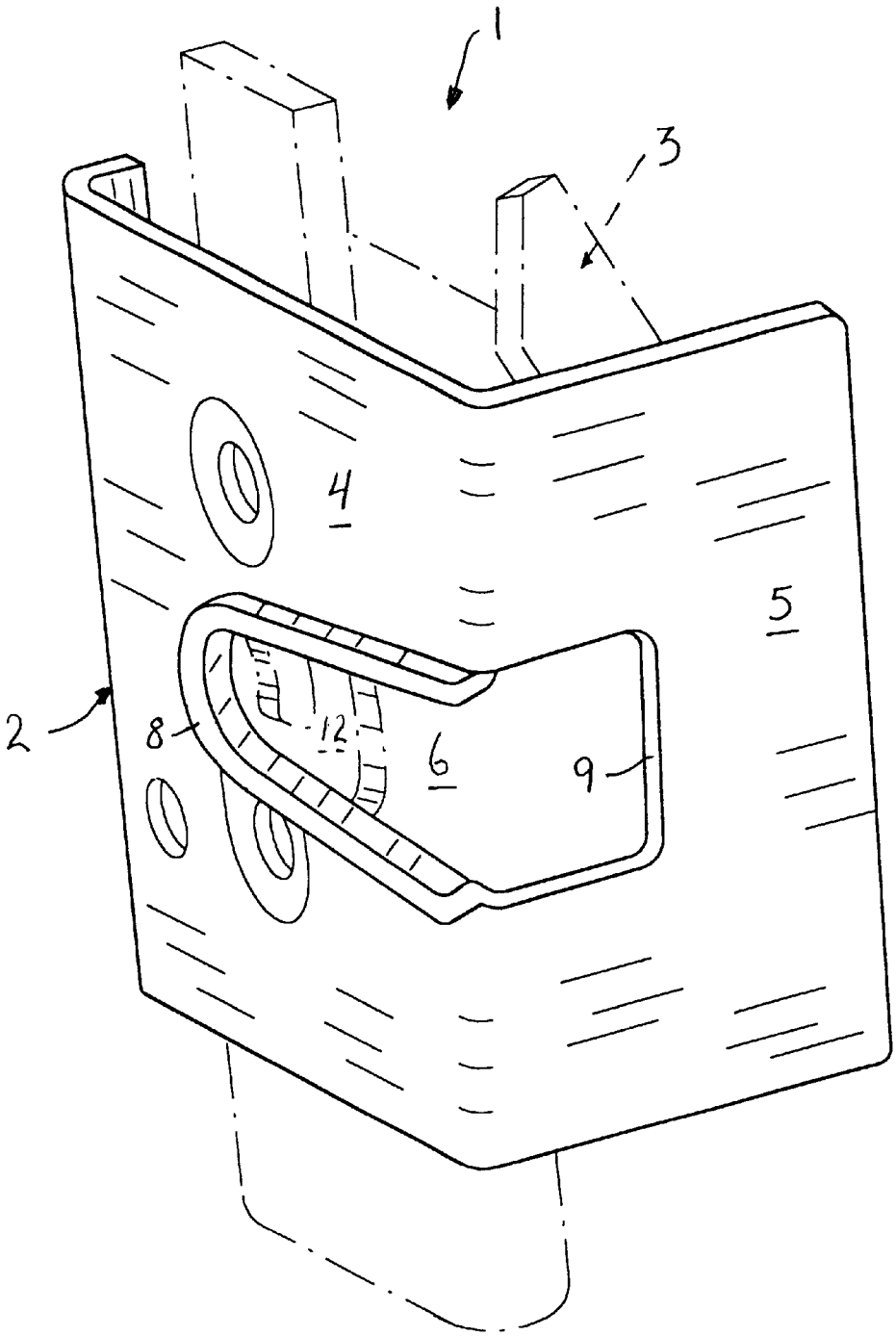
Fig. 1 (Prior Art)
FIG. 1 is a simplified perspective representation of a motor vehicle door lock according to the prior art.

FIG. 1 shows a motor vehicle door lock 1 according to the prior art. The motor vehicle door lock 1 has a metallic carrier plate 2 and an associated locking mechanism 3 which is indicated only by a broken line.

The carrier plate 2 has a flat side 4 which conventionally forms the external flat side of the motor vehicle door lock 1 and a side section 5 which is bent from the flat side 4. Furthermore, the carrier plate 2 has an inlet slot 6 which is made as an opening of the carrier plate 2 and which extends from the flat side 4 of the carrier plate 2 into the side section 5 of the carrier plate 2.

The inlet slot 6 is intended for a clamp 7 (not shown in FIG. 1 but shown in FIG. 3 ) which, with the motor vehicle door, the rear hatch, or the like closed, is inserted into the inlet slot 6, and in the inlet slot 6 can be secured in the area of the flat side 4 by the locking mechanism 3 which is directly or indirectly supported on the carrier plate 2 or connected to it.

The inlet slot 6 is provided with a bent edge section 8 in the area of the flat side 4 which extends along the edge 9 of the inlet slot 6. The edge section 8 is made in one piece with the carrier plate 2 and is produced by outward bending, i.e., away from the locking mechanism 3. The edge section 8 extends, in the embodiment shown in FIG. 1, also around the end of the inlet slot 6 located in the flat side 4 so that, with respect to the lengthwise extension of the inlet slot 6, the areas of the edge section 8 opposite one another are connected to one another in the end area; however, this is not absolutely essential.

Figure 2:
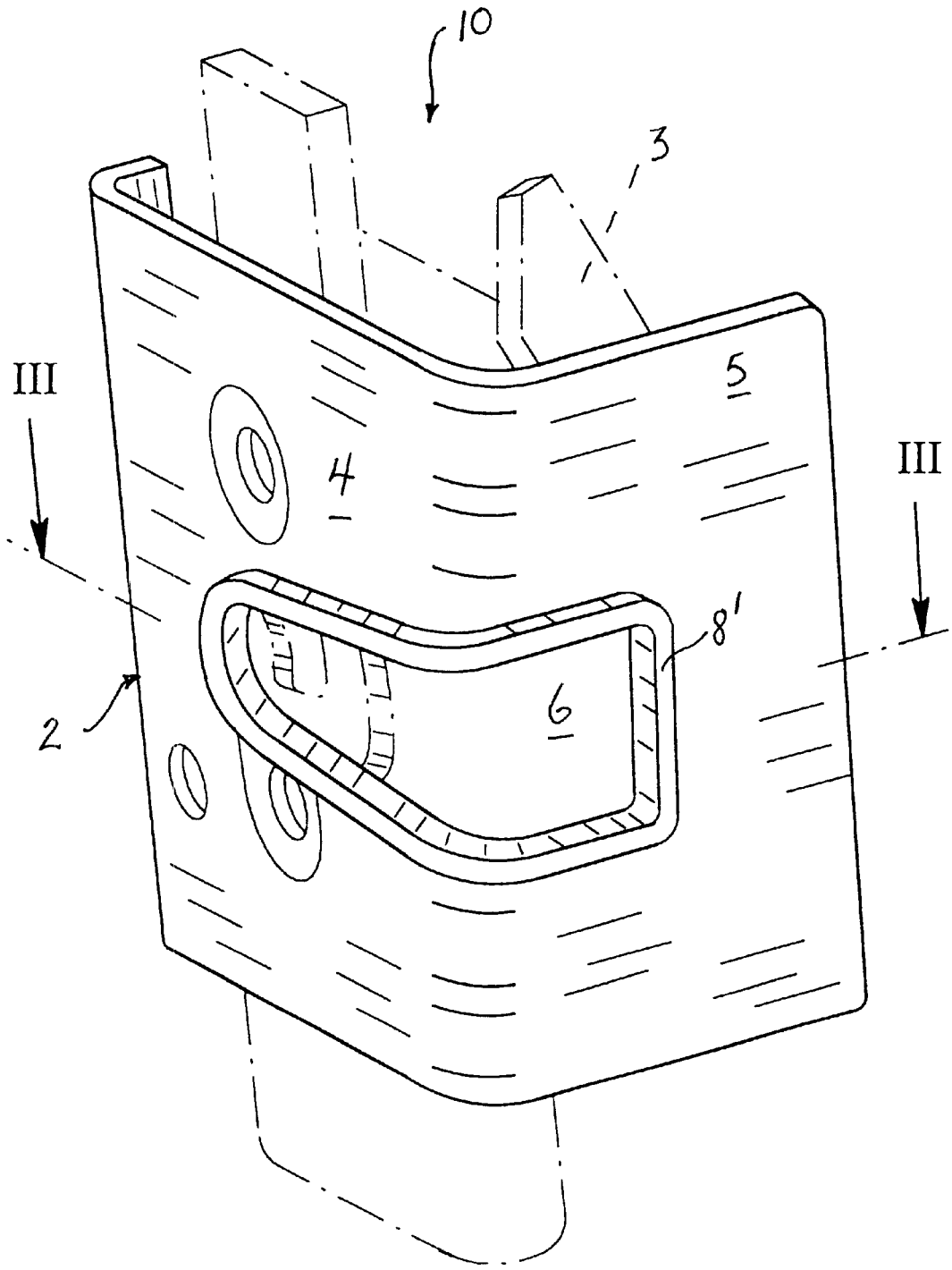
FIG. 2 a simplified perspective representation of a motor vehicle door lock according to a preferred embodiment of the present invention.
Figure 3:
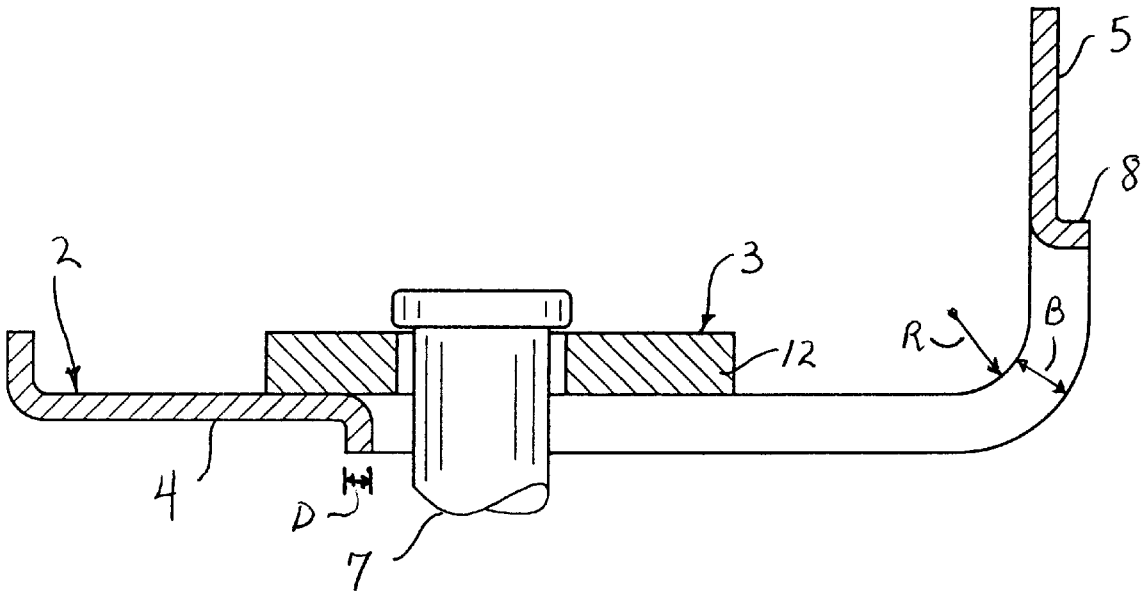
FIG. 3 is a sectional view of the motor vehicle door lock of the present invention taken along line III—III in FIG. 2.

In the following, this invention is explained using one preferred embodiment of a motor vehicle door lock 10 in accordance with the invention as shown in FIGS. 2 & 3. For the same or similar parts and components, the same reference numbers as are used as for the embodiment shown in FIG. 1 and a repeated description is omitted; essentially only the differences or modifications relative to the above described prior art are described.

FIG. 2 shows the motor vehicle door lock 10 in accordance with the invention in a perspective representation which corresponds to FIG. 1. It is clearly recognizable that the edge section 8', unlike edge section 8 of FIG. 1, not only extends along the edge 9 of the inlet slot 6 in the flat side 4 of the carrier plate 2, but also from the flat side 4 around the bend in the carrier plate 2 into the side section 5. In the illustrated embodiment, the bent edge section 8' is also formed continuously around the end of the inlet slot 6 that is located in the side section 5. However, this is not absolutely essential. But preferably, as shown, the edge section 8' is made continuous around the entire edge of the inlet slot 6. The cross sectional view shown in FIG. 3 illustrates that the edge section 8' bent outward.

FIG. 3 illustrates that the bending radius R with which the flat side of the carrier plate 2 passes into the side section 5 of the carrier plate 2 is made comparatively large relative to the prior art (compare also FIGS. 1 & 2 in the area of the bend at the upper edge of the carrier plates 2). The bending radius R is chosen to be large at least such that formation of the edge section 8' around this bending area, therefore in the passage from the flat side 4 to the side section 5, is possible.

Preferably, the bending radius R corresponds to the edge section 8' such that the edge section 8', in the curvature or bending area where it passes from the flat side 4 to the side section 5 is not overstretched and does not tear. In particular, the bending radius R is chosen to be as small as possible, but much larger than in the prior art.

The bending radius R, of course, depends on the width B of the edge section 8', i.e., on the amount by which the edge section 8' projects from the surface of the carrier plate 2, here to the outside, in the bending area of the passage from the flat side 4 to the side section 5.

If necessary, the width B of the edge section 8' along the edge of the inlet slot 6 can vary. In this way, optimum stiffening can be achieved depending on the loading of the carrier plate 2. In particular, the bending radius R can be reduced if desired when the width B is reduced in the bending or transition area from the flat side 4 to the side section 5.

The possible minimum bending radius R, of course, depends on the properties of the material used, especially its stretching capacity.

Furthermore, the bending radius R can be influenced by the thickness D of the edge section 8' which conventionally corresponds to the thickness of the plate material which is used for the carrier plate 2. If desired, the thickness D of the edge section 8' could vary along the edge 9 of the inlet slot 6. This can be achieved in particular by deformation of the plate material in the area of the edge section 8', for example, by upsetting.

Making the motor vehicle door lock 10 or the edge section 8' in accordance with the invention leads to a surprisingly large increase in the stiffness of the carrier plate 2 and the tensile strength of the motor vehicle door lock 1.

The motor vehicle door lock 10 according to the invention can also be produced relatively easily. For example, before bending the side section 5, the inlet slot 6 is punched out of the still flat carrier plate 2 with the formation of the edge section 8' which runs peripherally preferably closed and then the side section 5 is bent with the bending radius R. In particular the carrier plate 2 is a formed or bent part consisting of sheet metal.

FIG. 3 shows the clamp 7 of the motor vehicle door lock 10 which is inserted into the inlet slot 6 and is secured in the area of the flat side 4 by the locking mechanism 3, here a lock latch 12 of the lock mechanism 3. Therefore, the motor vehicle door lock 10 is in the closed state here.

The lock mechanism 3 is preferably supported at least partially on the carrier plate 2. This applies especially to the lock latch 12. Thus, the stable carrier plate 2 leads to high stiffness, load-bearing capacity and tensile strength of the motor vehicle door lock 10.

Of course, the carrier plate 2 can have other bends, recesses or projections, for example, for support of the lock mechanism 3 or the like. The motor vehicle door lock 10 especially has additional, otherwise conventional parts, such as a housing, a cover hood, an actuator or position sensors which are omitted here for reasons of simplification.

An entirely different approach to the aforementioned problem is offered by the carrier plate 2 being formed as a plastic molding, especially a plastic injection molding, made of a high-strength plastic and the edge section 8' extending from the flat side 4 over the bend into the side section 5 along the edge of the inlet slot 6.

Here in particular, it is recommended that the plastic of the carrier plate 2 is a plastic which has been reinforced by an additional material, especially is fiber-reinforced or fabric-reinforced.

With this alternative, especially in an injection molding process, the bent edge section 8 can be molded in completely beforehand, so that the stiffening function arises perfectly. With this measure it is possible to achieve a lighter execution than with a nonmetallic carrier plate 2 in the motor vehicle door lock component which is sensitive in terms of safety engineering.

High strength plastics are known from the prior art in a plurality of forms Reference should be made to the pertinent technical literature, especially for fiber-reinforced plastics which are being continually developed (see, among others, Rompp Chemistry, 10th edition, volume 2, 1997, page 1289).

While only one embodiment of the present invention has been shown and a few modifications discussed, it is susceptible to numerous other changes and modifications as will be apparent to those skilled in the art . Thus, it is intended that the invention not be limited to the preferred embodiment and that it encompasses the full scope of the appended claimes.

What is claimed is:

1. Motor vehicle door lock with a metallic carrier plate and a locking mechanism, the carrier plate having one flat side, one side section connected to the flat side via a transitional bend, and an inlet slot for a striker of the motor vehicle door lock which can be secured by the locking mechanism, wherein the inlet slot extends from the flat side into the side section and has an outward integral bent edge section of said carrier plate which extends, along at least part of an edge of the inlet slot, from around the inlet slot in the flat side via the transitional bend into the side section and along an edge of the inlet slot in the side section wherein the carrier plate, in the transitional bend, has a bending radius that corresponds to the stretching capability of the bent edge section in the transitional bend, farming a flange.

2. Motor vehicle door lock as claimed in claim 1, wherein the carrier plate is mechanically deformed essentially only by bending.

3. Motor vehicle door lock as claimed in claim 1, wherein the edge section has at least one of a width and thickness which varies along the edge of the inlet opening.

4. Motor vehicle door lock as claimed in claim 1, wherein the edge section extends continuously along the entire edge of the inlet slot.

5. Motor vehicle door lock with a carrier plate and a locking mechanism, the carrier plate having one flat side, one side section connected to the flat side via a transitional bend, and an inlet slot for a striker of the motor vehicle door lock, which striker can be secured by the flat side into the side section, wherein the inlet slot has an outward integral bent edge section forming a flange which extends along at least part of an edge of the inlet slot from around the inlet slot in the flat side via the transitional bend into the side section and along an edge of the inlet slot in the side section, wherein the carrier plate is a plastic molding made of high-strength plastic, and wherein the outward bent edge section is a molded portion of the carrier plate.

6. Motor vehicle door lock as claimed in claim 5, wherein the plastic of the carrier plate is a plastic which has been reinforced by an additional material.

7. Motor vehicle door lock as claimed in claim 5, wherein the edge section extends continuously along the entire edge of the inlet slot.

8. Motor vehicle door lock as claimed in claim 5, wherein the edge section has at least one of a width and a thickness which varies along the edge of the inlet opening.

* * * * *